United States Patent [19]

Kusumoto et al.

[11] Patent Number: 4,786,942

[45] Date of Patent: Nov. 22, 1988

[54] IMAGE FORMING APPARATUS

[75] Inventors: Keiji Kusumoto, Toyokawa; Kaoru Hashimoto, Toyohashi; Kenzo Nagata, Okazaki, all of Japan

[73] Assignee: Minolta Camera Kabushiki Kaisha, Osaka, Japan

[21] Appl. No.: 83,039

[22] Filed: Aug. 7, 1987

[30] Foreign Application Priority Data

| | | | |
|---|---|---|---|
| Aug. 9, 1986 | [JP] | Japan | 61-187607 |
| Aug. 9, 1986 | [JP] | Japan | 61-187608 |
| Aug. 9, 1986 | [JP] | Japan | 61-187609 |
| Aug. 11, 1986 | [JP] | Japan | 61-188279 |
| Aug. 11, 1986 | [JP] | Japan | 61-188280 |

[51] Int. Cl.[4] ..... G03G 15/08

[52] U.S. Cl. ..... 355/14 D; 355/3 DD; 355/14 R; 118/663; 118/688; 222/350

[58] Field of Search ..... 355/14 D, 3 DD, 3 R, 355/14 R; 118/663, 688; 222/35 D, DIG. 1, 368

[56] References Cited

U.S. PATENT DOCUMENTS

| | | | |
|---|---|---|---|
| 4,277,003 | 7/1981 | Tabuchi et al. | 222/350 |
| 4,416,535 | 11/1983 | Tottori | 355/14 D |
| 4,536,080 | 8/1985 | Hauser et al. | 355/14 D |
| 4,550,998 | 11/1985 | Nishikawa | 355/14 D X |

*Primary Examiner*—A. C. Prescott

*Attorney, Agent, or Firm*—Burns, Doane, Swecker & Mathis

[57] ABSTRACT

An electrostatic latent image formed on a surface of a photoconductor drum 61 of a copying apparatus is caused to be visible by a developing device 4. The developing device 4 comprises a toner tank 43 and a toner supply roller 44 for supplying toner to a developer container 45. A toner density in the developer container 45 is detected by a sensor 11 and a detecting circuit 1. When irregular supply of toner is requested through a switch 91, a control circuit 2 compares the detected toner density with a prescribed density and drives the roller 44 to supply toner till the detected density attains the prescribed density. If copy operation is instructed through a switch 92 during the supply of toner, the control circuit 2 permits the copy operation and the supply of toner is continued during the copy operation.

15 Claims, 16 Drawing Sheets

IMAGE FORMING APPARATUS

BACKGROUND OF THE INVENTION

1. Field of the Invention

The present invention relates to an image forming apparatus. More particularly, the present invention relates to an image forming apparatus in which an improvement is made in a toner supplying method.

2. Description of the Prior Art

A copying machine, a laser printer or the like generally includes an image forming portion in which an electrostatic latent image formed on a photoconductor is caused to be visible by means of toner in two-constituent developer and the toner image is transferred onto a sheet of copy paper or the like. In such an image forming apparatus, the toner contained in the developer stored in a developer container is consumed and decreased as a result of development of an electrostatic latent image and consequently it is necessary to newly supply a suitable amount of toner.

For that reason, various methods such as indicated below are conventionally utilized.

(1) Method in which a toner density in developer is detected by making use of the phenomenon that inductance of a coil of a magnetic sensor provided in a developing device changes due to change in the toner density in the developer, and an additional amount of toner is supplied to the developer based on the detected value during operation of the developing device.

(2) Method in which an electrostatic latent image for control of toner supply is formed and developed on a surface of a photoconductor by using, for example, a reference chart having a prescribed image density, prior to copy operation, to optically detect a density of the developed image and an additional amount of toner is supplied to the developer based on the detected value during operation of the developing device.

However, the amount of toner supplied by those methods is set based on an amount of toner to be consumed by image forming operation using a document having an average density of image. In addition, toner supply by those methods is made in a limited short period, for example, during image forming operation.

Accordingly, for example if toner is excessively consumed because of successive copying of documents having high image densities and if toner supply continues with a toner density in developer being lower than a prescribed value, it sometimes happens that the toner density in the developer in the developing device does not attain again the prescribed value since the toner supply is stopped in a short period of time. As a result, copy operation continues with a decreased image density.

SUMMARY OF THE INVENTION

Accordingly, it is an object of the present invention to provide an image forming apparatus in which a suitable amount of toner is supplied as required and a toner density in developer can be always maintained constant.

Briefly stated, the present invention is an image forming apparatus which is capable of not only performing regular toner supply operation with prescribed timing during image forming operation but also continuing supply operation till a detected value of toner density attains the prescribed density in response to irregular toner supply instruction.

According to another aspect of the present invention, the image forming apparatus permits a start of image forming operation during irregular toner supply operation and continues the toner supply operation even in the permitted image forming operation. In addition, if the detected toner density is lower than the prescribed density at the end of the permitted image forming operation, the toner supply operation is further continued.

According to a further aspect of the present invention, the image forming apparatus does not perform image forming operation till irregular toner supply is terminated if image forming operation start instruction is issued during irregular toner supply operation, and it automatically performs image forming operation when the irregular toner supply is terminated.

According to a still further aspect of the present invention, if irregular toner supply operation is instructed during multi-operation for forming a plurality of images, the image forming means interrupts the multi-operation and effects irregular toner supply, and when the irregular toner supply is terminated, it restart the multi-operation.

These objects and other objects, features, aspects and advantages of the present invention will become more apparent from the following detailed description of the present invention when taken in conjunction with the accompanying drawings.

DESCRIPTION OF THE PREFERRED EMBODIMENTS

First of all, description will be made of a mechanical construction and fundamental copy operation of a copying apparatus to which the present invention is applied.

Figure 1:
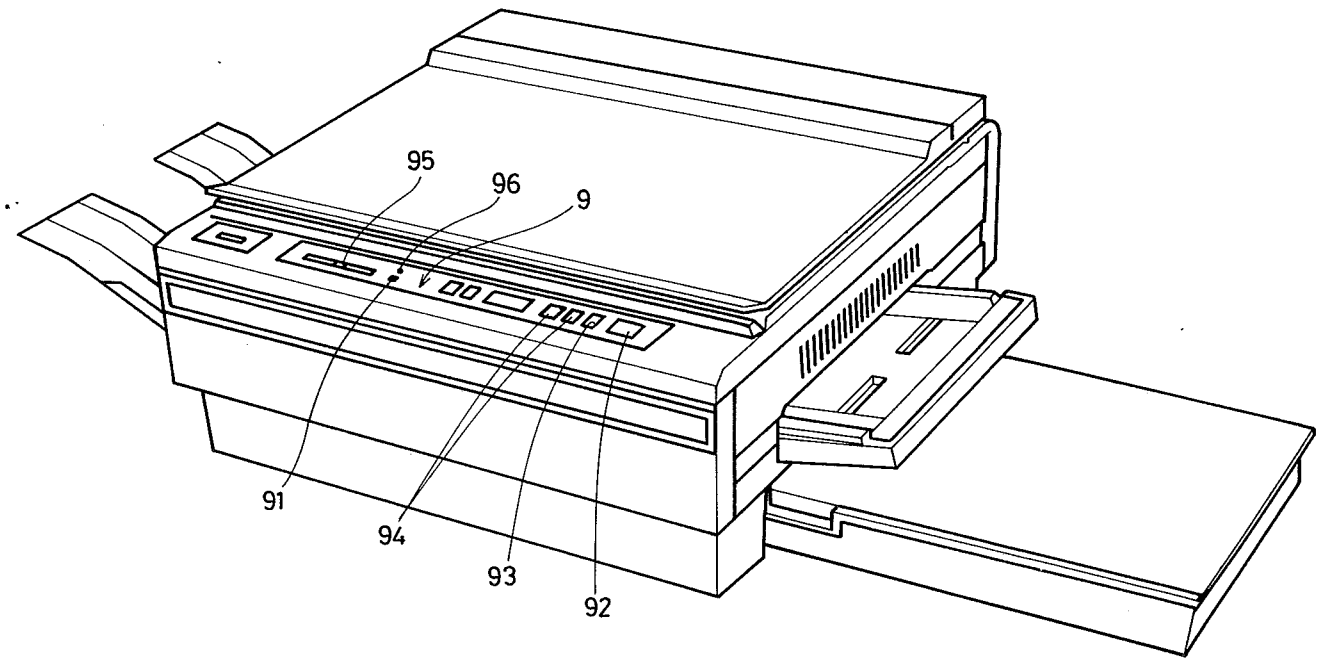
FIG. 1 is a perspective view showing appearance of a main body of a copying apparatus of an embodiment of the present invention.
Figure 2:
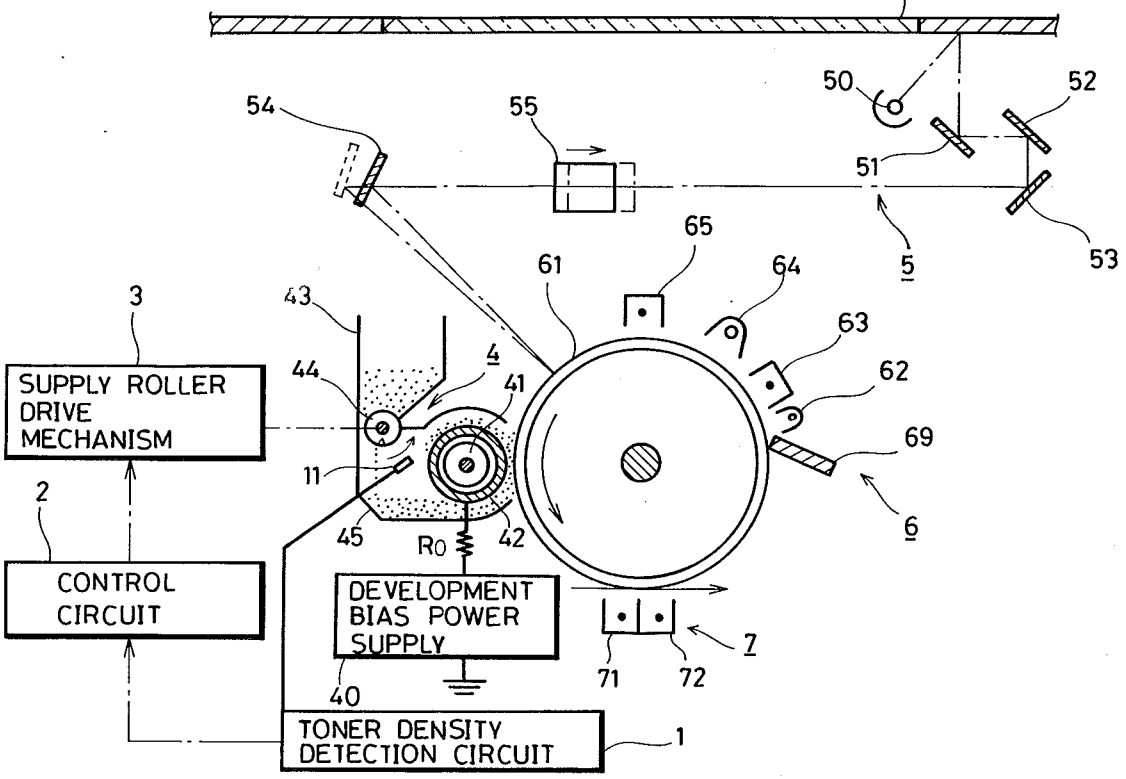
FIG. 2 is a typical view showing construction around a developing device of the copying apparatus shown in FIG. 1.

FIG. 1 is a perspective view showing an appearance of a main body of a copying apparatus of any of first to third embodiments of the invention to be described below and FIG. 2 is a typical view for explaining a construction around a developing device of the copying apparatus.

The copying apparatus comprises: an optical system 5 (comprising components 50 to 55) for scanning a document by exposure and projecting an image corresponding to the document successively on a surface of a photoconductor drum 61 to be described afterwards; an electrostatic recording portion 6 (comprising components 61 to 69) for recording the projected image as an electrostatic latent image on the photoconductor drum 61; a developing device 4 (comprising components 40 to 45) for causing the electrostatic latent image on the photoconductor drum 61 to be visible by means of toner; a transfer portion 7 (comprising components 71 and 72) for transferring the visible toner image on a sheet of copy paper; a feeding and discharging system (not shown) for feeding sheets of copy paper; a fixing device (not shown) for fixing the image; and a document table 8 of glass on which a document is placed. The copying apparatus thus constructed performs prescribed operation and displays prescribed data by detecting inputs through various keys (provided on an operation panel 9 shown in FIG. 1) and inputs through sensors.

The optical system 5 comprises a light source 50, mirrors 51, 52, 53 and 54, a lens 55, and a drive mechanism not shown. This optical system 5 moves in forward and backward directions repeatedly along a lower surface of the document table 8 so that a surface of a document is exposed to light and scanned in the forward direction. More specifically, light reflected from the document is reflected on the mirrors 51, 52 and 53 and then passes through the lens (a lens block for variable magnification) 55. The light is further reflected on the mirror 54 and attains the photoconductor drum 61 so that an image corresponding to the document is projected on the surface of the drum 61.

The mirrors 51, 52 and 53 are driven together by the same motor for scanning (not shown). A moving speed of the light source 50 and the mirror 51 is V/N (N being a copying magnification) with respect to a rotating speed V of the photoconductor drum 61 and a moving speed of the mirrors 52 and 53 is V/2N with respect to the circumferential speed V of the drum 61 so as to keep a length of an optical path constant. On the other hand, the mirror 54 and the lens 55 are driven together by a magnification setting motor (not shown). The lens 55 moves along an optical axis to change the copying magnification and the mirror 54 moves and sways to correct an imaging point.

The electrostatic recording portion 6 comprises the photoconductor drum 61 driven to rotate in an arrow direction, and components provided around the drum 61, namely, a main eraser lamp 62, an auxiliary charger 63, an auxiliary eraser lamp 64, a main charger 65, and a cleaning device 69 of a blade type.

A photoconductor layer is formed on the surface of the drum 61. The photoconductor layer is sensitized increasingly when the drum 61 moves along the eraser lamps 62 and 64 and the chargers 63 and 65, so that the photoconductor layer continuously receives in a slit manner the image projected from the optical system 5 to form an electrostatic latent image.

The developing device 4 is a device of a magnetic brush type comprising a development sleeve 42, and a magnetic roller 41 contained in the developing sleeve 42. The development sleeve 42 is disposed in a developer container 45 in a manner in which the axis of the sleeve 42 is parallel to the axis of the photoconductor drum 61 and the external surface of the sleeve 42 is opposed to the external surface of the photoconductor drum 61 with a prescribed spacing. The development sleeve 42 is connected with a development bias power supply 40 through a self-bias resistor Ro. As the developer, two-constituent developer composed of toner and magnetic carrier is used.

A toner tank 43 is provided in an upper portion of the developer container 45 so that toner in the toner tank 43 is supplied to the developer container 45 through notches formed on a circumferential surface of a toner supply roller 44 provided at the bottom of the toner tank 43 when the toner supply roller 44 is rotated. Thus, an amount of toner supplied for one revolution of the toner supply roller 44 is constant.

A toner density sensor 11 is disposed in a prescribed position in the developer container 45 so that an electric signal of a level corresponding to a toner density in the prescribed position is supplied to a control circuit 2 through a toner density detection circuit 1. The toner density sensor 11 is a magnetic sensor for detecting permeability of the developer.

The control circuit 2 is constituted mainly by a microcomputer as described afterwards and it controls a supply roller drive mechanism 3 in response to a detection signal from the toner density sensor 11 or the like to effect regular supply of toner when the developing device 4 operates (forms an image) and to effect irregular supply of toner based on an input signal from a toner supply switch 91 (shown in FIG. 1).

The image caused to be visible by the toner is transferred electrostatically onto a sheet of copy paper by means of a transfer charger 71 and the sheet of copy paper is separated from the photoconductor drum 61 by means of a separation charger 72. Sheets of copy paper are fed to the transfer portion 7 one by one by a paper feeder (not shown) and then discharged outside the copying apparatus through the fixing device (not shown).

Figure 3:
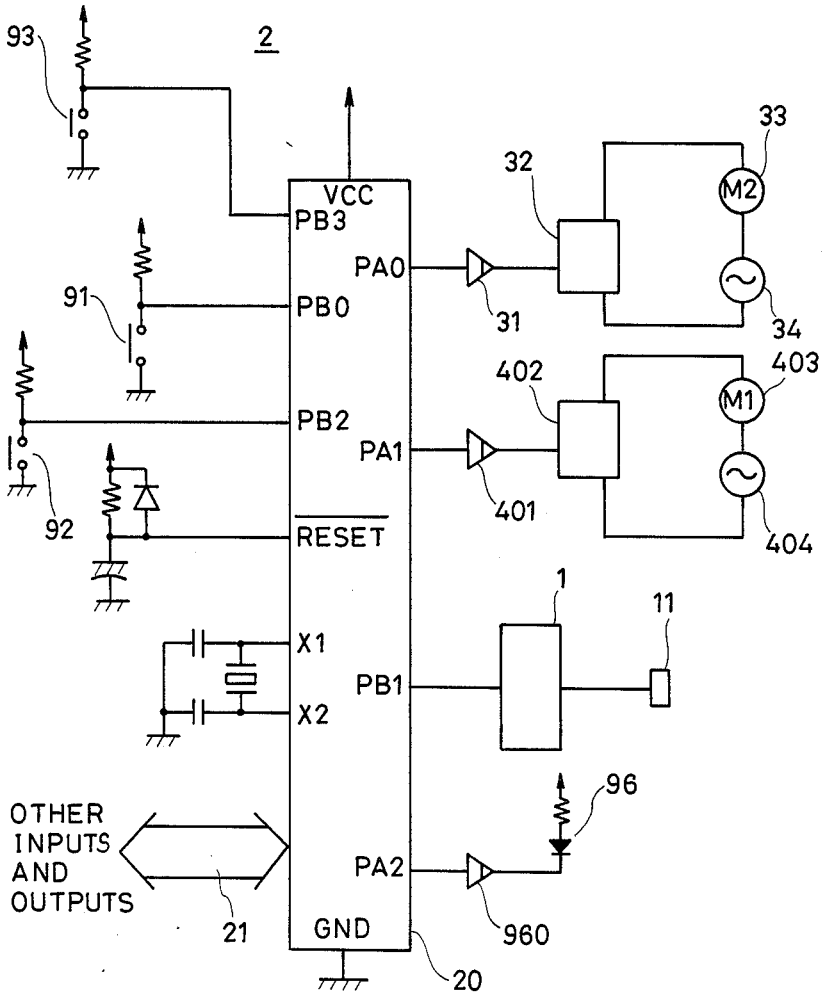
FIG. 3 is a circuit diagram showing details of a control circuit 2 shown in FIG. 2.

FIG. 3 is a circuit diagram showing details of the control circuit 2 shown in FIG. 2.

As shown, the control circuit 2 has a MPU (microprocessing unit) 20 formed by a 1-chip microcomputer and the MPU 20 is connected to other input and output terminals and other microcomputers through an interface 21.

An output port PAO of the MPU 20 is connected with a solid-state relay SSR32 through a driver circuit 31 so that a toner supply motor 33 can be driven by an AC power supply 34 of 25 V. The driving of the motor 33 is effected in a state in which an output signal from the output port PAO is at a low level.

An output port PA1 is connected with a solid-state relay SSR402 through a driver circuit 401 so that a development motor 403 (for driving the development sleeve, the magnetic roller, a developer stirring member and the like) can be driven by an AC power supply 404 of 100 V. The driving of the motor 403 is effected in a state in which an output signal from the output port PA1 is at a low level, in the same manner as described above.

An output port PA2 is connected with a supply request display LED element 96 (shown in FIG. 1) through a driver circuit 960 so that the display LED element 96 is illuminated when an output signal from the output port PA2 is at a low level.

On the other hand, an input port PB0 is connected with a toner supply switch 91 (shown in FIG. 1) and an on-state of the switch 91 is inputted to the input port PB0 as a low level signal.

An input port PB1 is connected with the toner density sensor 11 through the toner density detection circuit 1 and a state in which a detected toner density is lower than a prescribed value (6 wt % in the present embodiment) is inputted to the input port PB1 as a high level signal.

An input port PB2 is connected with a print switch 92 (shown in FIG. 1) and when the switch 92 is turned on, a low level signal is inputted to the input port PB2.

An input port PB3 is connected with a clear stop key 93 (shown in FIG. 1) and an on-state of the switch 93 is inputted to the input port PB3 as a low level signal. The clear stop key 93 instructs stop of copy operation and clearance of set values during copy operation and instructs stop of toner supply during supply of toner by the toner supply switch 91.

Now, operation of the copying apparatus of the embodiment of the invention will be described.

Figure 4:
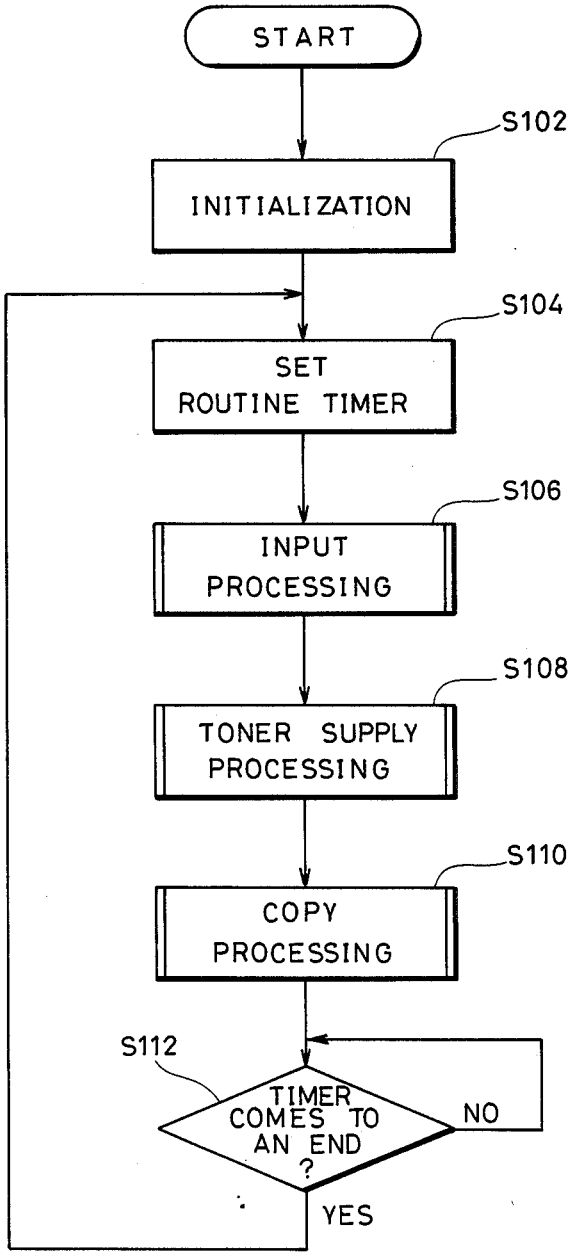
FIG. 4 is a flow chart showing a main routine of an MPU 20 shown in FIG. 3.

FIG. 4 is a flow chart showing a main routine of the MPU 20. The MPU 20 starts processing when the power supply is turned on, and after initialization in the step S102, the MPU 20 sets a routine timer for defining a period of one routine (in the step S104).

Then, in the step S106, input processing of signals from the keys and the sensors is performed. Input processing related with toner supply will be described afterwards in detail with reference to FIG. 5.

Subsequently in the step S108, toner supply processing is performed. Details of the toner supply processing will be described afterwards with reference to FIG. 6.

Then, in the step S110, processing related with copy operation is performed. In this processing, a copy operation start flag to be described below is set and when a sequence of procedures are completed, this flag is reset.

After that, the MPU 20 waits for an end of the routine timer set in the step S104 and then returns to the step S104 (in the step S112).

Figure 5:
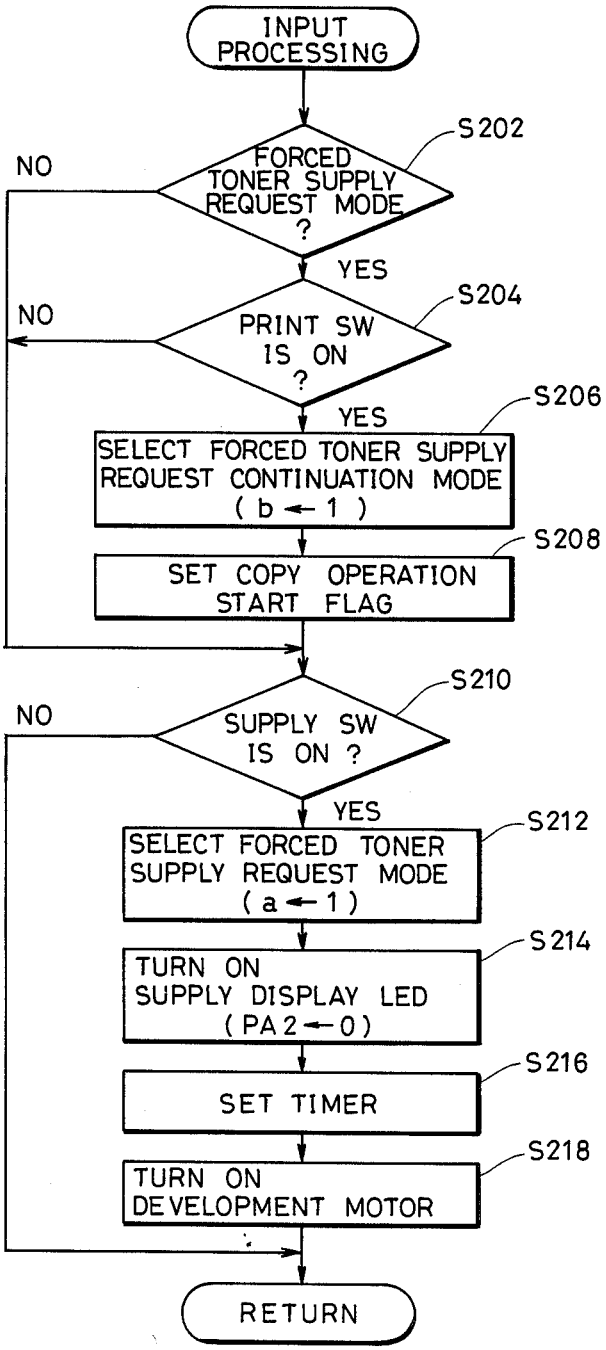
FIG. 5 is a flow chart showing details of input processing related with toner supply in a first embodiment of the present invention.

FIG. 5 is a flow chart showing details of the input processing related with toner supply in the first embodiment of the invention.

First, various flags mentioned in the following explanation will be described.

Flag a: a forced toner supply request mode flag which is set when the toner supply switch 91 is turned on.

Flag b: a forced toner supply request continuation mode flag which is set when the print switch 92 is turned on during forced supply of toner.

Flag c: a small amount supply mode flag which is set when the toner density is normal.

Flag d: a toner supply mode flag which is set when the toner density is decreased.

As shown in FIG. 5, it is first determined whether a forced toner supply request mode is set or not (in the step S202). In other words, a state of the forced toner supply request mode flag a is determined.

Then, in the step S204, it is determined whether the print switch 92 is turned on or not. More specifically, a signal level of the input port PB2 of the MPU 20 is determined. A low level corresponds to the on-state of the switch 92.

If the on-state of the print switch 92 in the forced toner supply request mode is detected by the determination in the step S204, the flag b is set to select the forced toner supply request continuation mode (in the step S206) and a copy operation start flag is set to perform copy operation processing (in the step S208). More specifically, the copy operation start flag is set to perform the processing for controlling operation of the copying apparatus in the step S110, such as driving of the optical system 5 and the photoconductor drum 61, transfer and fixation of an image on copy paper and discharge of the copy paper. Although not shown, the copy operation start flag is set when the print switch 92 is turned on in modes other than the forced toner supply request mode.

Thus, if the print switch 92 is turned on during irregular supply of toner by input through the toner supply switch 91 in the steps S202 to S208, copy operation is performed during the supply of toner. In this case, toner supply operation in the forced toner supply request mode is continuously performed. The supply request display LED element 96 is illuminated during copy operation.

In the step S210, it is determined whether the toner supply switch 91 is turned on or not. If the on-state of the switch 91 is detected, the flag a is set to select the forced toner supply request mode (in the step S212) and the supply request display LED element 96 is turned on (in the step S214). If the forced toner supply mode is selected, a timer for driving the development motor for a prescribed period is set (in the step S216), whereby the development motor is turned on (in the step S218). Thus, the developer is stirred prior to measurement of the toner density so that the toner density in the developer may be uniform. The on-state of the toner supply switch 91 is determined by a signal level applied to the input port PBO of the MPU 20. The supply request display LED element 96 is turned on when the signal from the output port PA2 attains the low level.

Thus, the input processing related with toner supply in the first embodiment is performed.

Figure 6A:
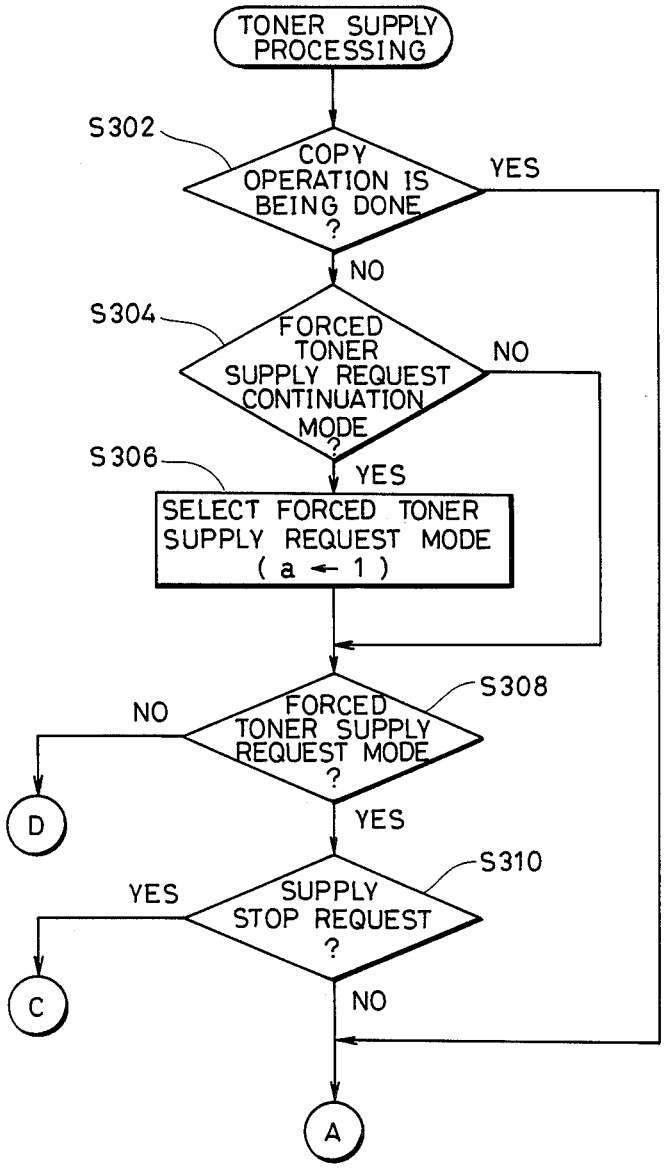
FIGS. 6A to 6C are flow charts showing details of toner supply processing in the first embodiment of the present invention.
Figure 6B:
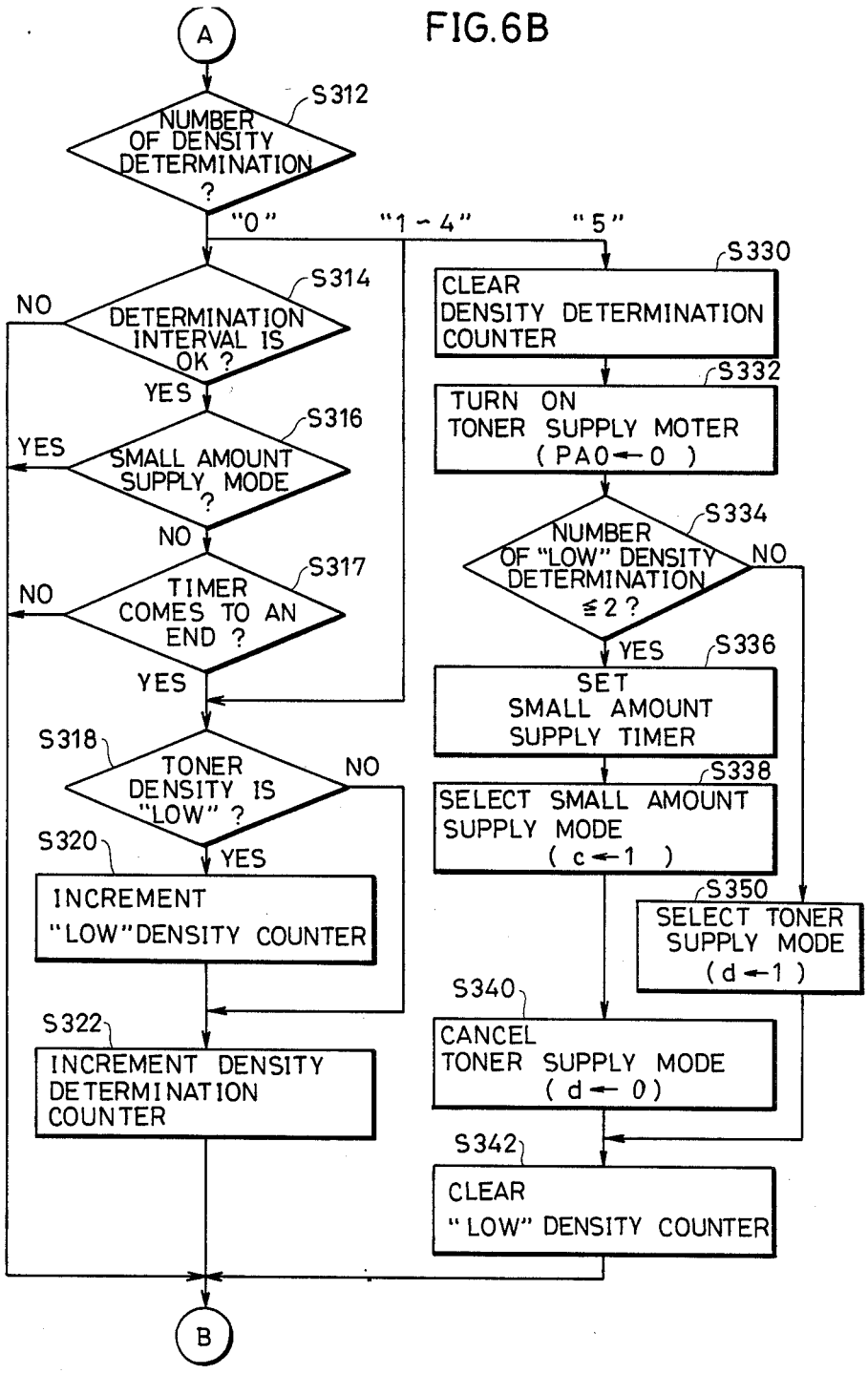
Figure 6C:
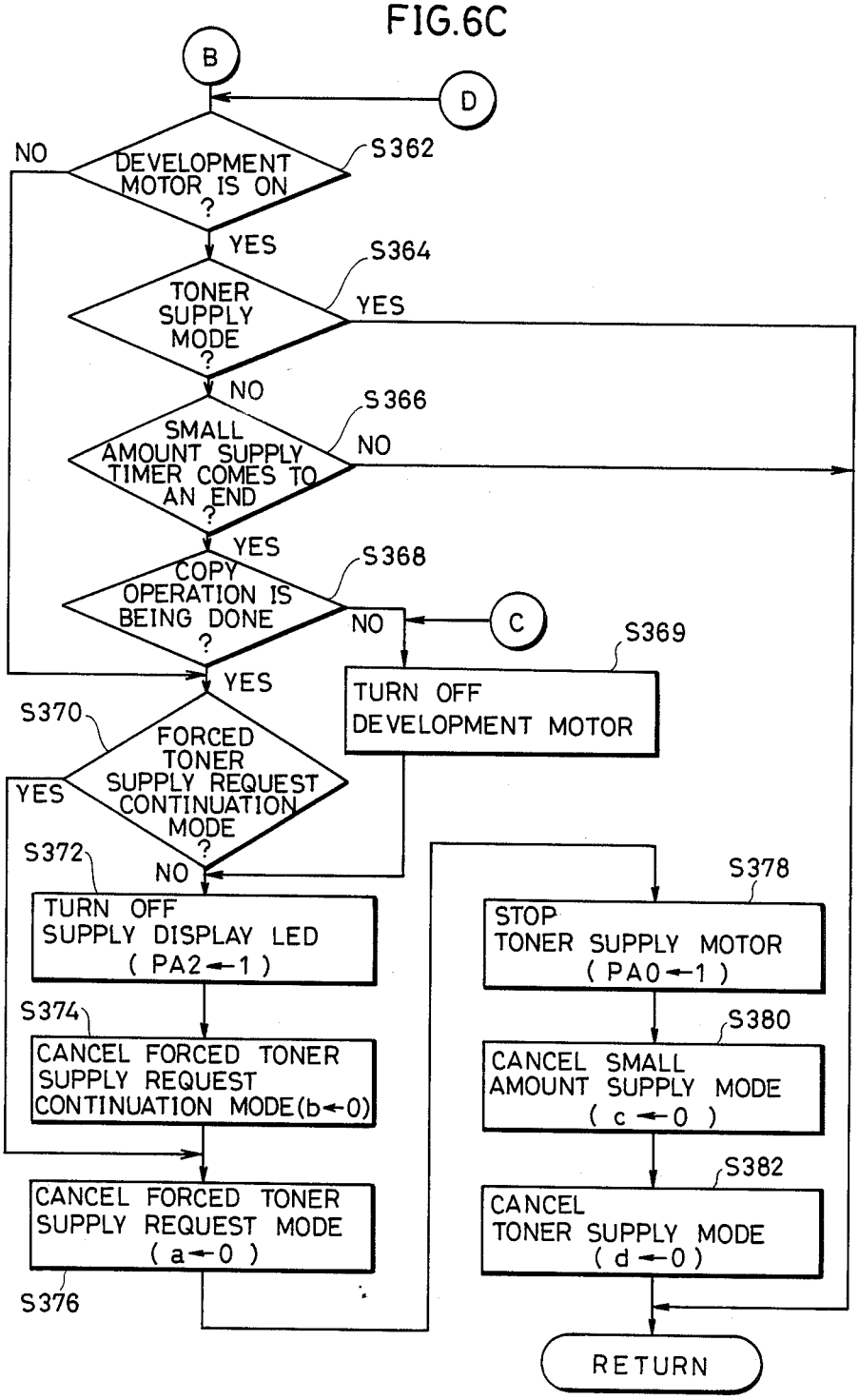

FIGS. 6A to 6C are flow charts showing details of toner supply processing in the first embodiment.

First, in the step S302, it is determined whether copy operation is being performed by the copying apparatus. If it is determined that copy operation is being performed, the program jumps to the step S312 to perform processing for selecting the toner supply mode or the small amount supply mode (in the steps S312 to S350) dependent on the detected toner density. More specifically, if copy operation is being performed during supply of toner in the forced toner supply request mode, the supply of toner is continuously effected.

If it is determined that copy operation is not being performed, the program proceeds to the step S304 to determine a state of the above mentioned flag b. In other words, it is determined whether the forced toner supply request continuation mode is selected or not.

If it is determined that the flag b=1, namely, the forced toner supply request continuation mode is selected, the program proceeds to the step S306, in which the flag a is set to select the forced toner supply request mode. Thus, after the copy operation processing started in the above stated step S208 is completed, the toner density in the developer is measured again and if the copy operation processing is completed with a lowered toner density, irregular supply of toner is effected.

After that, the program proceeds to the step S308 to determine whether the forced toner supply request mode is selected or not. If it is determined as a result of the above stated determination in the step S304 that the forced toner supply request continuation mode is not selected, the program proceeds directly to the step S308.

If it is determined in the step S308 that the flag a=0, namely, the forced toner supply request mode is not selected, the program proceeds to the step S362. More specifically, if the forced toner supply request mode is not selected, toner supply operation is stopped when the copy operation processing is completed. In other words, regular supply o toner is not effected after completion of the copy operation processing irrespective of the toner density of the developer.

If it is determined in the step S308 that the forced toner supply request mode is selected, the program proceeds to the step S312 on condition that a supply stop request is not issued (in the step S310). The supply stop request is a request issued to the MPU 20 when supply of toner cannot be effected or supply of toner is forbidden, because of an empty state of the toner tank 43, or the on-state of the clear stop key 93, for example.

The steps S312 to S350 (in FIG. 6B) relate to processing for selecting the toner supply mode for supplying toner based on a result of comparison between a detected toner density and a prescribed value, and the small amount supply mode for supplying toner to compensate for an unavoidably consumed amount of toner irrespective of development of an electrostatic latent image, due to fine particles of toner splashed outside the developing device.

First in the step S312, the number of density determinations performed so far is checked. The density determination corresponds to a determination in the step S318 described below, in which the toner density detected by the toner density sensor 11 is compared with the prescribed value.

If it is determined that the density determination to be performed is the first determination, it is confirmed in the step S314 that the MPU 20 have waited for a prescribed period (200 msec. in this embodiment) after the previous density determination and then the program proceeds to the step S316 to determine based on the flag c whether the small amount supply mode is selected or not. If it is determined that the small amount supply mode is selected, the program jumps over the steps S317 to S350 and advances directly to the step S362 to supply a prescribed amount of toner. The prescribed amount of toner is a small amount of toner estimated to be unavoidably consumed irrespective of a development process of an electrostatic latent image, for example in the form of fine particles splashed outside the developing device. This prescribed amount of toner is set by the small amount supply timer.

If it is determined in the step S316 that the flag c=0, namely, the small amount supply mode is not selected, the MPU 20 waits for an end of the timer set in the above stated step S216 (in the step S317) and then proceeds to the step S318 to compare the detected toner density with the prescribed value. More specifically, a level of a signal inputted to the input port PB1 of the MPU 20 from the toner density sensor 11 through the toner density detection circuit 1 is determined. The determination in the step S317 as to whether the timer comes to an end or not is performed only during toner supply operation in the forced toner supply request mode.

If the level of the input signal is high, this means that the detected toner density is lower than the prescribed value and, accordingly, the program proceeds to the step S320 to increment by one a counter (a low density counter) which counts when the detected toner density is lower than the prescribed value. After that, the program proceeds to the step S322. On the other hand, if the level of the input signal is low, that is, if the detected toner density is higher than the prescribed value, the program proceeds directly to the step S322.

In the step S322, a density determination counter is incremented by one. This counter is used for checking the number of density determinations in the above stated step S312.

If it is determined in the above stated step S312 that the number of density determinations performed so far is a number from 1 to 4, the program proceeds to the above stated step S318, to perform the same procedures as described above, such as checking of the detected toner density.

If it is determined in the above stated step S312 that the number of density determinations performed so far already attains 5, the program proceeds to the step S330 to clear the density determination counter, and after that, the toner supply motor 33 is turned on in the step S332. Thus, the output signal from the output port PAO falls to the low level. As a result, supply of toner from the toner tank 43 into the developer container 45 can be started.

Then, in the step S334, the detected toner density and the prescribed value are compared. More specifically, if the number of determinations that the detected density is "low" is three or more out of five determinations as to the toner density (in the step S318), it is determined that the detected toner density is lower than the prescribed value, and the program proceeds to the step S350 to select the toner supply mode by setting the toner supply more flag d. Consequently, supply of toner is continued while the toner supply mode is selected, that is, in a period in which the determination of "the detected toner density < the prescribed value" in the step S334 is maintained). Accordingly, a necessary amount of toner for increasing the toner density to the prescribed value is supplied. Since the toner supply motor 33 is turned on in the step S332, this supply is continued till the toner supply mode and the small amount supply mode are cancelled.

If it is determined in the step S334 that the number of determinations of "low" density is smaller than three out of five determinations (in the step S318), it is determined that the detected toner density is higher than the prescribed value, and accordingly that it is substantially not necessary to supply toner. Then, the program proceeds to the step S336 to set the small amount supply timer to a prescribed period. After that, the program proceeds to the step S338, in which the small amount supply mode is selected by setting the small amount supply mode flag c. Then, the toner supply mode is cancelled (in the step S340). As a result, toner is supplied till the above stated small amount supply timer comes to an end (in the step S366). Thus, the above stated prescribed amount of toner is supplied.

Subsequently, the program proceeds to the step S342 to clear the "low" density counter. If the forced toner supply request mode is not selected, toner supply operation in the toner supply mode or in the small amount supply mode is stopped when copy operation processing comes to an end (for example, after automatic shutting). On the other hand, in the case of the forced toner supply request mode, supply operation is stopped when it is completed if there is no supply stop request.

The steps S362 to S382 (in FIG. 6C) are steps for controlling a period of continuation of toner supply.

More specifically, if the development motor 403 is turned on (in the step S362) and the toner supply mode is selected (in the step S364), supply of toner is continued for a period in which the toner supply mode is selected (this period corresponding to a period in which the toner density is determined to be low in the step S334).

On the other hand, if the development motor 403 is turned on (in the step S362) and the toner supply mode is not selected (in the step S364), supply of toner is continued for a given period till the small amount supply timer comes to an end (in the step S366).

If it is determined in the step S366 that the small amount supply timer comes to an end, the program proceeds to the step S368 to determine whether copy operation is being performed or not.

If it is determined that copy operation is being performed and it is determined in the step S362 that the development motor 403 is stopped by completion of copy operation at the end of an automatic shutter timer or by interruption of copy operation by means of the clear stop key 93, the program proceeds to the step S370 to determine whether the forced toner supply request continuation mode is selected or not, that is, whether the flag b is set or not.

If it is determined in the step S370 that the forced toner supply request continuation mode is not selected, the program proceeds to the step S372. Further, if it is determined in the step S368 that copy operation is not being performed (that is, irregular supply of toner is completed) or if a supply stop request is issued in the step S310, the development motor 403 is turned off in the step S369, and then the program also proceeds to the step S372. In the step S372, the output signal from the output port PA2 attains the high level and the supply request display LED element 96 is turned off. After that, the program proceeds to the step S374 to cancel the forced toner supply request continuation mode by resetting the flag b and then it proceeds to the step S376. Thus, the flag a is reset to cancel the forced toner supply mode (in the step S376); the output signal from the output port PAO is changed to the high level to stop the toner supply motor 33 (in the step S378); the flag c is reset to cancel the small amount supply mode (in the step S380); the flag d is reset to cancel the toner supply mode (in the step S382). Then, the program returns to the main routine.

On the other hand, if it is determined in the step S370 that the forced toner supply request continuation mode is selected (that is, copy operation performed during irregular supply of toner is completed), the program proceeds to the step S376 to perform the above mentioned steps S376 to S382.

According to the above described first embodiment, the irregular toner supply mode is provided in addition to the regular toner supply mode to be applied during copy operation and, accordingly, if it happens that a sufficient toner density cannot be maintained by the regular toner supply as a result of multi-copy of a high-density document or the like, the toner density can be caused to attain the prescribed value. For this purpose, only one input operation of a key is required. In addition, since copy operation is permitted even during irregular supply of toner, the apparatus is suited for frequent use in a hurry or suited as a printer of a facsimile.

Figure 7:
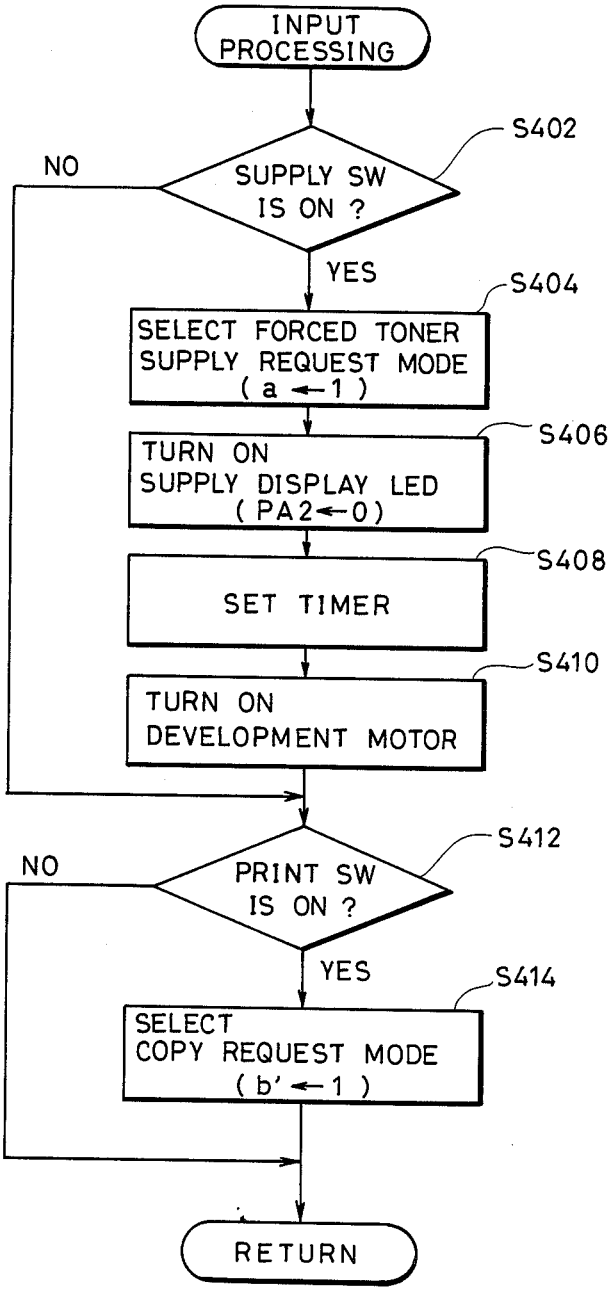
FIG. 7 is a flow chart showing details of input processing related with toner supply in a second embodiment of the present invention.

FIG. 7 is a flow chart showing details of input processing related with toner supply in the second embodiment of the invention.

First, various flags mentioned in the following explanation will be described.

Flag a: a forced toner supply request flag which is set when the toner supply switch 91 is turned on.

Flag b': copy request flag which is set when the print switch 92 is turned on during forced supply of toner.

Flag c: a small amount supply mode flag which is set when the toner density is normal.

Flag d: a toner supply mode flag which is set when the toner density is decreased.

As shown in FIG. 7, first of all, it is determined in the step S402 whether the toner supply switch 91 is turned on or not. If the on-state is detected, the flag a is set to select the forced toner supply request mode (in the step S404) and the supply request display LED element 96 is turned on (in the step S406). When the forced toner supply mode is selected, a timer for driving the development motor 403 for a prescribed period is set (in the step S408) and then the development motor 403 is turned on (in the step S410). Thus, the developer is stirred prior to measurement of a toner density so that the toner density in the developer is uniform. The on-state of the toner supply switch 91 is determined by a level of a signal to the input port PBO of the MPU 20 and the turning on of the supply request display LED element 96 is effected when a signal from the output port PA2 attains the low level.

In the step S412, it is determined whether the print switch 92 is turned on or not. More specifically, a signal level of the input port PB2 of the MPU 20 is determined. The low level corresponds to the on-state of the switch 92.

If it is determined in the step S412 that the print switch 92 is in the on-state during irregular supply of toner by means of the toner supply switch 91, the flag b' is set to select the copy request mode (in the step S414) for the purpose of performing copy operation after the supply of toner (in the step S568). Although not shown, a copy operation start flag is set when the print switch 92 is turned on in modes other than the forced toner supply mode.

Thus, input processing related with toner supply in the second embodiment is performed.

Figure 8A:
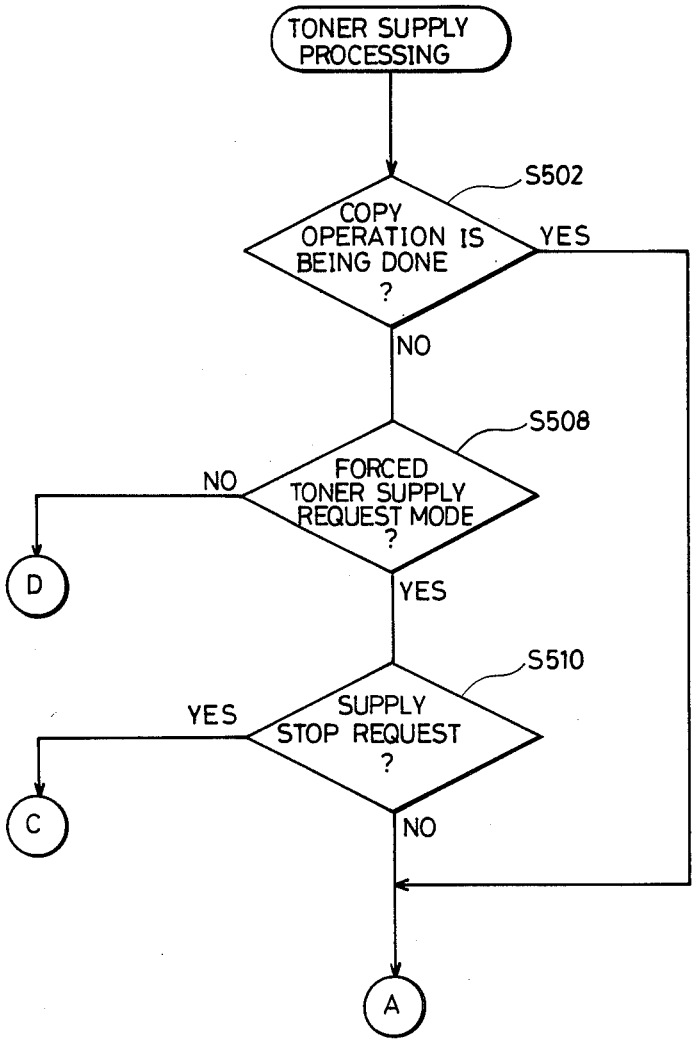
FIGS. 8A to 8C are flow charts showing details of toner supply processing in the second embodiment of the present invention.
Figure 8B:
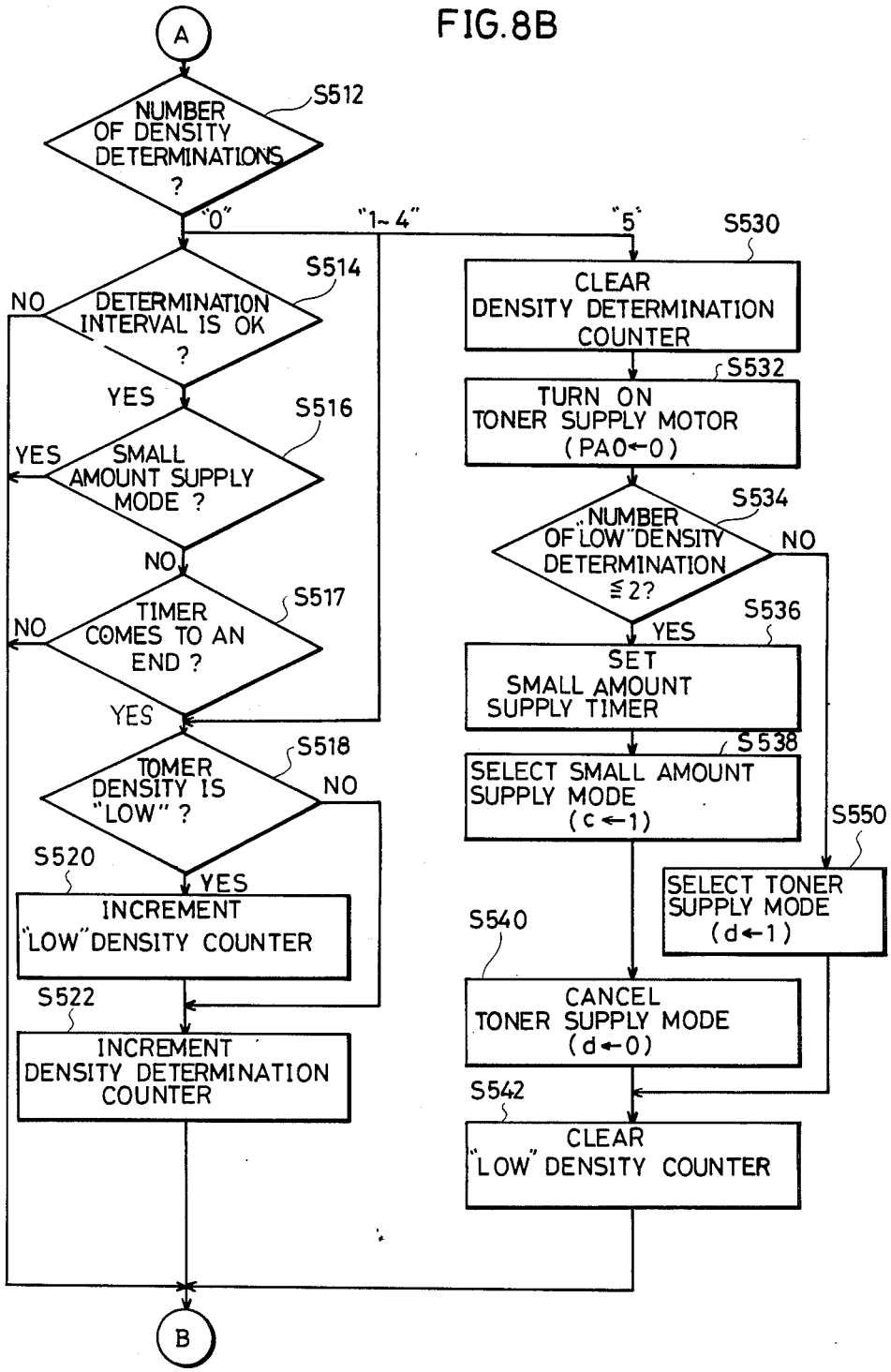
Figure 8C:
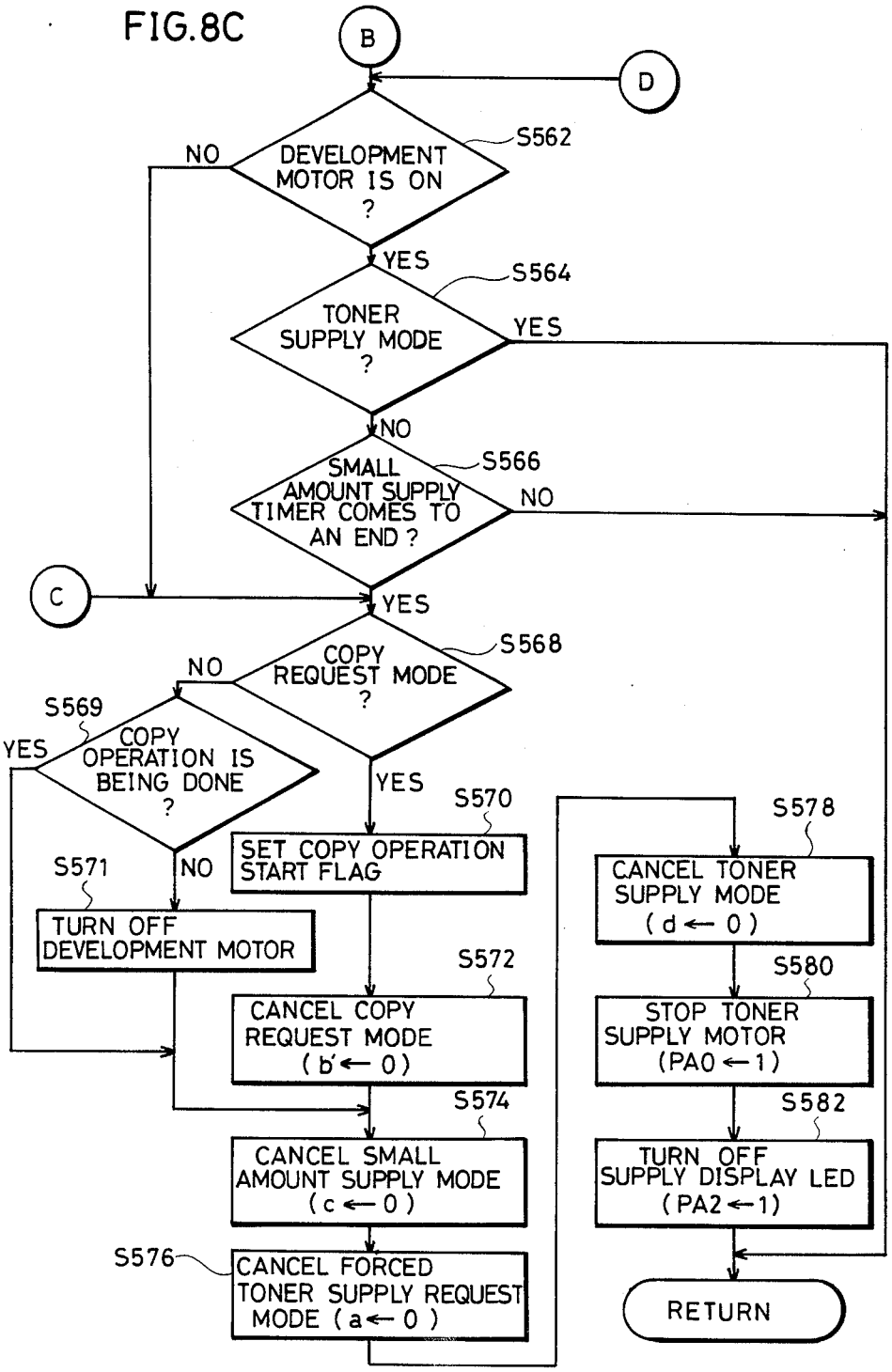

FIGS. 8A to 8C are flow charts showing details of toner supply processing in the second embodiment.

First, in the step S502, it is determined whether copy operation is being performed by the copying apparatus or not. If it is determined that copy operation is being performed, the program jumps to the step S512 to perform processing for selecting the toner supply mode or the small amount supply mode dependent on the detected toner density (in the steps S512 to S550).

If it is determined that copy operation is not being performed, the program proceeds to the step S508 to determine whether the forced toner supply request mode is selected or not.

If it is determined in the step S508 that the flag a=0, that is, the forced toner supply request mode is not selected, the program proceeds to the step S562. More specifically, if the forced toner supply request mode is not selected, toner supply operation is stopped when copy operation processing is completed. In other words, as for regular supply of toner, supply of toner is not effected after completion of copy operation processing irrespective of the toner density of the developer.

If it is determined in the step S508 that the forced toner supply request mode is selected, the program proceeds to the step S512 on condition that a supply stop request is not issued (in the step S510).

The steps S512 to S550 (in FIG. 8B) relate to processing for selecting the toner supply mode and the small amount supply mode. These steps S512 to S550 (shown in FIG. 8B) are the same as the above described steps S312 to S350 shown in FIG. 6B in connection with the first embodiment and therefore description thereof is omitted.

The steps S562 to S583 (shown in FIG. 8C) are steps for controlling a period of continuation of toner supply and the like.

More specifically, if the development motor 403 is in the on-state (in the step S562) and the toner supply mode is selected (in the step S564), supply of toner is continued for a period in which the toner supply mode is selected (this period corresponding to a period in which the toner density is determined to be low in the step S534).

On the other hand, if the development motor 403 is in the on-state (in the step S562) and the toner supply mode is not selected (in the step S564), supply of toner is continued for a given period till the small amount supply timer comes to an end (in the step S566).

If the small amount supply timer comes to an end in the step S566 and if it is determined in the above stated step S562 that the development motor 403 is stopped by completion of copy operation at the end of the automatic shutter timer or by interruption of copy operation by means of the clear stop key 93 and if a supply stop request is issued in the above stated step 510, the program proceeds to the step S568. In the step S568, it is determined whether the copy request mode is selected or not, that is, whether the flag b′ is set or not.

If the copy request mode is selected in the step S568, that is, the print switch 92 is turned on during forced supply of toner, the- program proceeds to the step S570 to set the copy operation start flag for starting copy operation processing. More specifically, when the print switch 92 is turned on during forced supply of toner, copy operation is started after the forced supply of toner. The copy operation processing relates to control necessary for copy operation, such as drive of the optical system 5, drive of the photoconductor drum 61, feeding of copy paper and drive of the fixing device. Since this processing is well-known, description thereof is omitted. Then, the program proceeds to the step S572 to cancel the copy request mode by resetting the flag b′. After that, the program proceeds to the step S574 and the subsequent steps.

On the other hand, if it is determined in the above stated step S568 that the copy request mode is not selected, the program proceeds to the step S569. If copy operation is not being performed in the step S569, for example, if the forced toner supply mode is brought to an end, the development motor 403 is turned off (in the step S571). Then, the program proceeds to the step S574 and the subsequent steps. More specifically, the flag c is reset to cancel the small amount supply mode (in the step S574); the flag a is reset to cancel the forced toner supply request mode (in the step S576); the flag d is reset to cancel the toner supply mode (in the step S578); the output signal from the output port PAO is brought to the high level to stop the toner supply motor 33 (in the step S580); and the output signal from the output port PA2 is brought to the high level to turn off the supply request display LED element 96 (in the step S582). Then, the program returns to the main routine.

According to the above described second embodiment, the irregular toner supply mode is provided in the same manner as in the first embodiment and, accordingly, a toner density can be maintained at a suitable value. In addition, if copy operation is requested during irregular supply of toner, the copy operation is not started till the irregular supply of toner is terminated, that is, till the toner density attains a prescribed value, and the set copy operation is automatically performed after the end of the irregular supply of toner. Consequently, copy operation of high quality can be performed in a good state in which insufficiency of toner density is dissolved.

Figure 9:
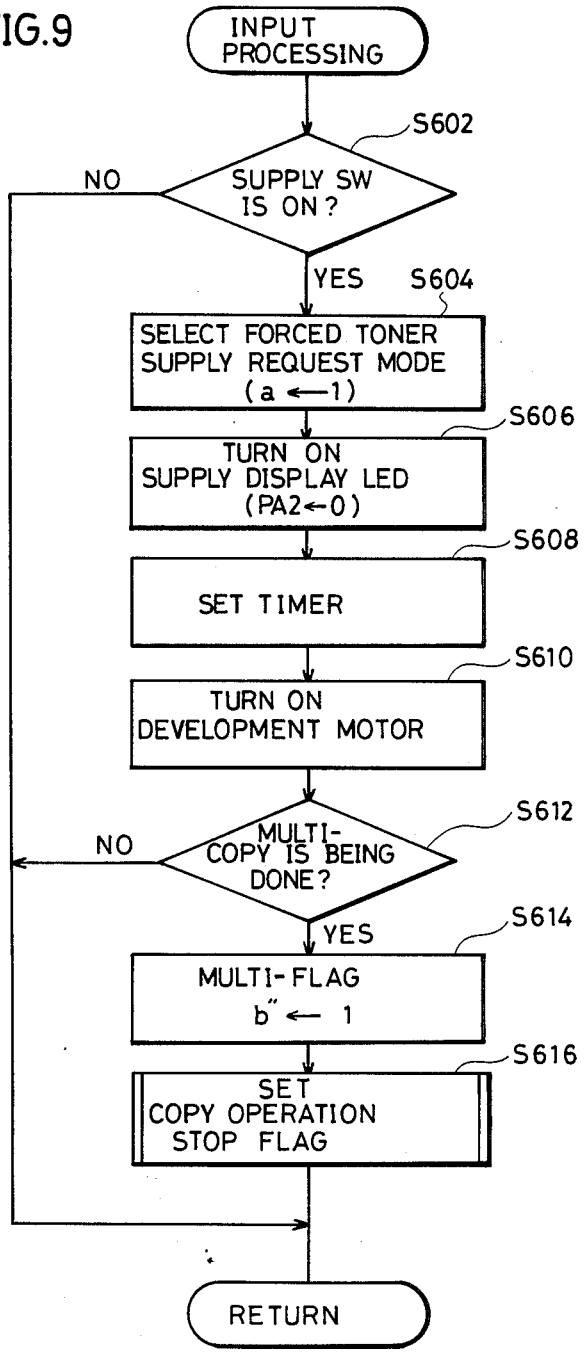
FIG. 9 is a flow chart showing details of input processing related with toner supply in a third embodiment of the present invention.

FIG. 9 is a flow chart showing details of input processing related with toner supply in the third embodiment.

First, various flags mentioned in the following explanation will be described.

Flag a: a forced toner supply request mode flag which is set when the toner supply switch 91 is turned on.

Flag b″: a multi-copy request mode flag which is set when the toner supply switch 91 is turned on during multi-copy operation.

Flag c: a small amount supply mode flag which is set when the toner density is formal.

Flag d: a toner supply mode flag which is set when the toner density is decreased.

As shown in FIG. 9, first in the step S602, it is determined whether the toner supply switch 91 is turned on or not. If the on-state of the switch 91 is detected, the flag a is set to select the forced toner supply request mode (in the step S604) and the supply request display LED element 96 is turned on (in the step S606). When the forced toner supply mode is selected, a timer for driving the development motor 403 for a prescribed period is set (in the step S608) and the development motor 403 is turned on (in the step S610). Thus, the developer is stirred prior to measurement of a toner density so that the toner density in the developer is uniform. The on-state of the toner supply switch 91 is determined by a level of a signal to the input port PBO of the MPU 20 and the turning on of the supply request display LED element 96 is effected when a signal from the output port PA2 attains the low level. If the toner supply switch 91 is not turned on in the step S602, the program returns to the main routine.

In the step S612, it is determined whether multi-copy operation is being performed or not when the forced toner supply switch 91 is turned on. If multi-copy operation is being performed, the flag b″ is set to select a multi-copy request mode (in the step S614). Thus, when supply of toner is instructed by the toner supply switch 91 during multi-copy operation, subsequent unit copy operations to be performed thereafter can be started after the end of the supply of toner. After that, a copy operation stop flag for executing copy operation stop processing is set (in the step S616). Thecopy operation stop processing is processing for forbidding start of the subsequent unit copy operations to be performed successively after a currently performed unit copy operation.

In the above described manner, input processing related with toner supply in the third embodiment is performed.

Figure 10A:
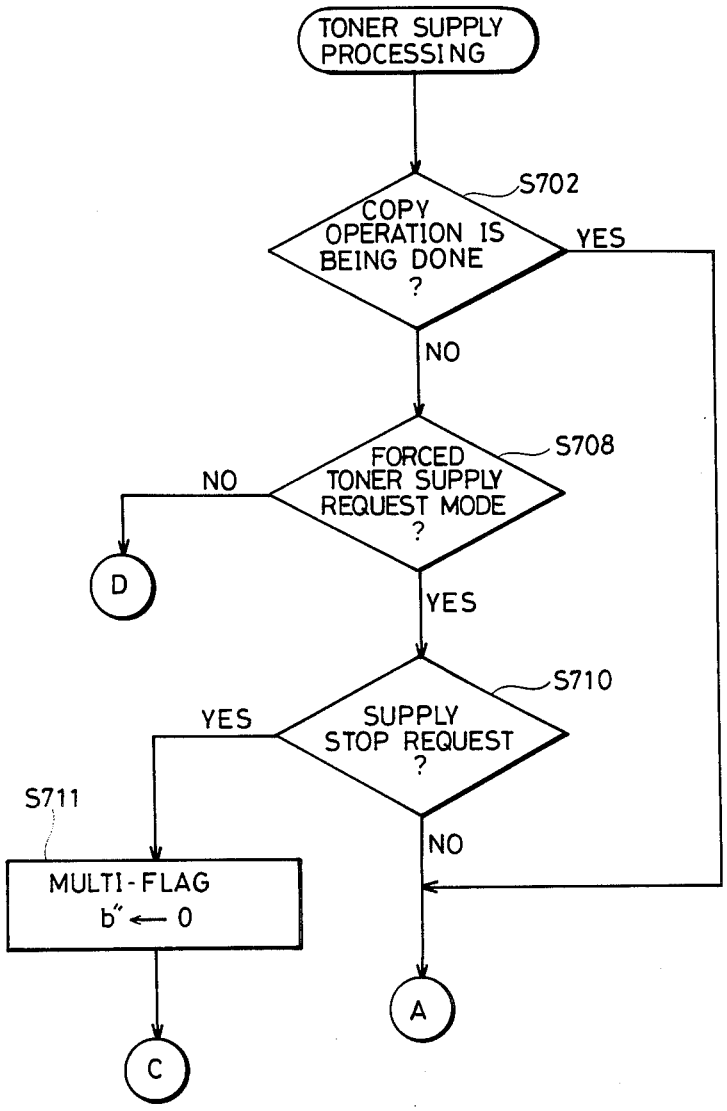
FIGS. 10A to 10C are flow charts showing details of toner supply processing in the third embodiment of the present invention.
Figure 10B:
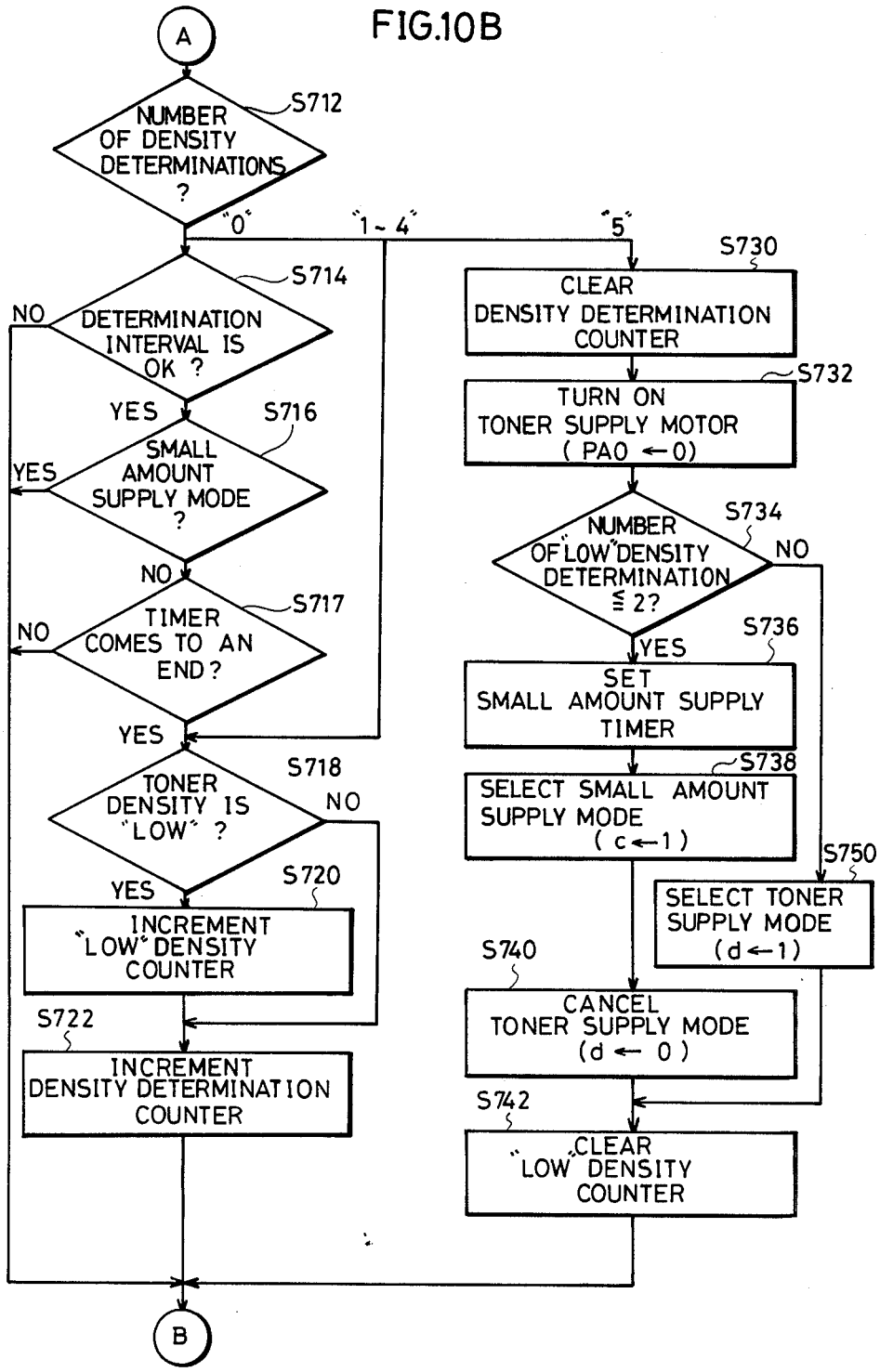
Figure 10C:
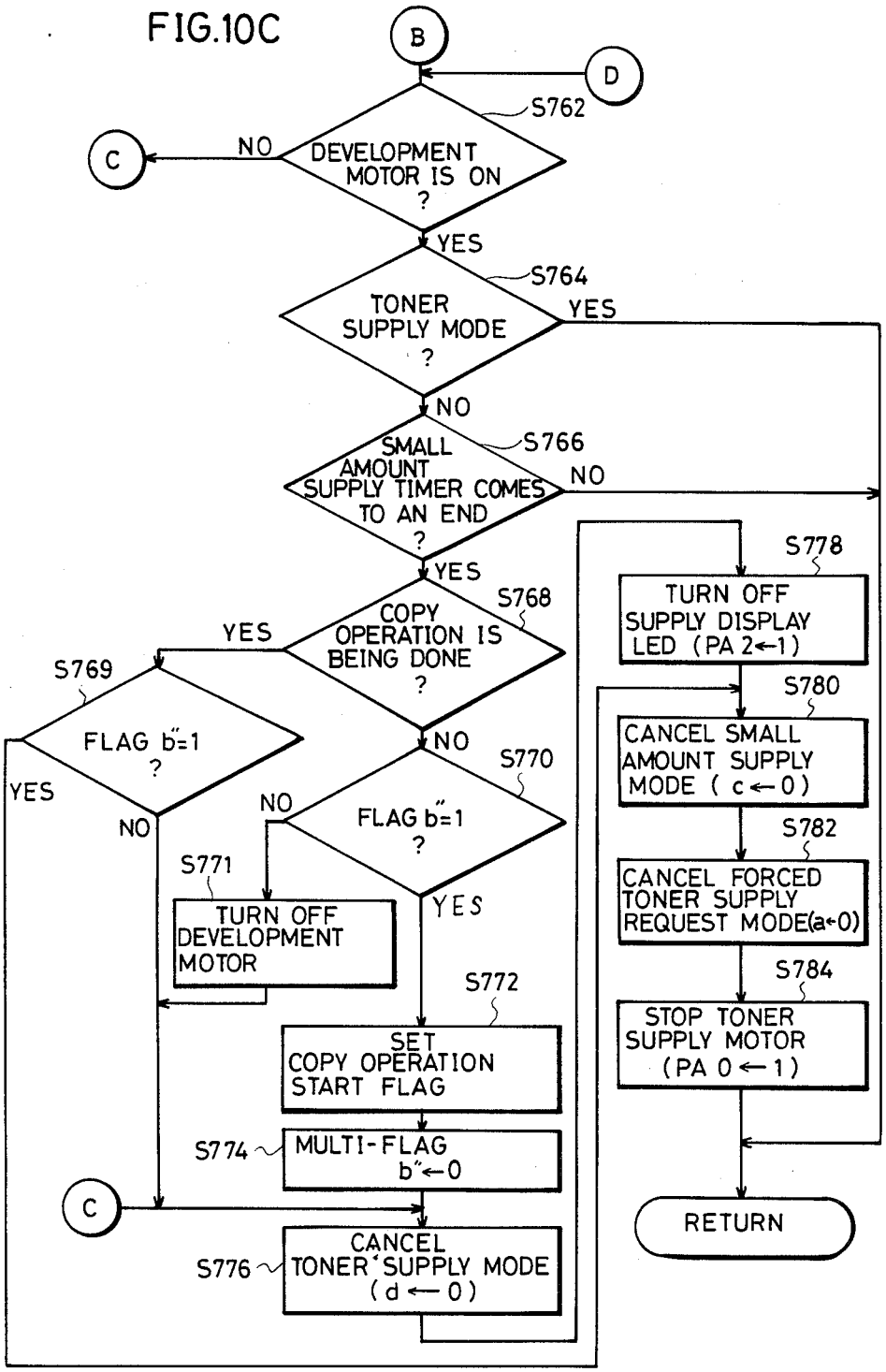

FIGS. 10A to 10C are flow charts showing details of toner supply processing in the third embodiment.

First, in the step S702, it is determined whether copy operation is being performed in the copying apparatus. If it is determined that copy operation is being performed, the program jumps to the step S712 to perform processing (in the steps S712 to S750) for selecting the toner supply mode or the small amount supply mode dependent on the detected toner density.

If it is determined that copy operation is not being performed, the program proceeds to the step S708 to determine whether the forced toner supply request mode is selected or not.

If it is determined in the step S708 that the flag is a=0, that is, the forced toner supply request mode is not selected, the program jumps to the step S762. More specifically, if the forced toner supply request mode is not selected, toner supply operation is stopped when copy operation processing is completed. In other words, regular toner supply is not effected after copy operation processing is completed, irrespective of a toner density of the developer.

If it is determined in the step S708 that the forced toner supply request mode is selected, the program proceeds to the step S712 on condition that a supply stop request is not issued (in the step S710). If a supply stop request is issued in the step S710, the flag b″ is reset (in the step S711) and the program proceeds to the step S776.

The steps S712 to S750 (in FIG. 10B) relate to processing for selecting the toner supply mode and the small amount supply mode. These steps S712 to S750 (shown in FIG. 10B) are the same as the above described steps S312 to S350 shown in FIG. 6B in connection with the first embodiment and therefore description thereof is omitted.

The steps S762 to S784 (shown in FIG. 10C) are steps for controlling a period of continuation of toner supply and the like.

More specifically, if the development motor 403 is in the on-state (in the step S762) and the toner supply mode is selected (in the step S764), supply of toner is continued for a period in which the toner supply mode is selected (this period corresponding to a period in which the toner density is determined to be low in the step S734).

On the other hand, if the development motor 403 is in the on-state (in the step S762) and the toner supply mode is not selected (in the step S764), supply of toner is continued for a given period till the small amount supply timer comes to an end (in the step S766).

If the small amount supply timer comes to an end in the step S766, it is determined in the step S768 whether copy operation is being performed or not.

If it is determined in the step S768 that copy operation is not being performed, the program proceeds to the step S770 to determine a state of the flag b″. If the flag b″=1, a copy operation start flag for performing copy operation is set (in the step S772). Thus, after forced toner supply operation performed after an image forming operation in the multi-copy mode on condition that the toner density is lower than the prescribed value, copy operation is restarted. After that, the flag b″ is reset (in the step S774). On the other hand, if the flag b″ is not 1 in the step S770, that is, the forced toner supply operation is completed, the program proceeds to the step S771 to turn off the development motor 403. The copy operation processing relates to control necessary for copy operation, such as drive of the optical system 5, drive of the photoconductor drum 61, feeding of copy paper and drive of the fixing device. Since this processing is well-known, description thereof is omitted.

If it is determined in the step S768 that copy operation is being performed, the program proceeds to the step S769 to determine a state of the flag b″. If the flag b″=1, this means that the unit copy operation performed in the on-state of the toner supply switch 91 is not completed. Consequently, the program jumps over the steps S776 and S778 and proceeds to the step S780 while the supply request mode is maintained. If the flag b″ is not 1, the program proceeds to the step S776.

If it is determined in the above stated step S762 that the development motor 403 is stopped by completion of copy operation at the end of the automatic shutter timer or by interruption of copy operation by means of the clear stop key 93, and if the flag b″ is not set in the step S769, the program proceeds to the step S776. In the step S776, the flag d is reset to cancel the toner supply mode and the output signal level from the output port PA2 is changed to the high level to turn off the supply request display LED element 96 (in the step S778). After that, the flag c is reset to cancel the small amount supply mode (in the step S780); the flag a is reset to cancel the supply request mode (in the step S782); and the output signal level from the output port PAO is changed to the high level to stop the toner supply motor 33 (in the step S784). Then, the program returns to the main routine.

According to the above described third embodiment, if the irregular toner supply instruction is issued during multi-copy operation, the multi-copy operation is temporarily stopped when the copy process at that time comes to an end, to perform irregular supply of toner and when the irregular supply of toner is completed, the multi-copy operation is restarted. Consequently, even if a toner density is lowered during multi-copy operation, the multi-copy operation can be restarted after the density reaches again the prescribed value, and thus, copy operation of high quality can be performed.

In the above described embodiments, the toner density in the developer container 43 is detected by the magnetic sensor 11 to control a toner supply amount for the developer. However, the present invention is not limited thereto. For example, a density of development based on an electrostatic latent image for control of toner supply formed on the surface of the photoconductor using a reference chart or the like may be detected by a photo sensor so that a toner supply amount can be controlled based on the detected value. In this case, the photo sensor may be disposed, for example, in a position near the photoconductor drum 61 between the separation charger 72 and the cleaning device 69.

Although each of the above described embodiments uses as toner supply means the toner tank 43 and the toner supply roller 44 positioned at the bottom of the toner 43, the present invention is not limited to such members. Any member may be used as the toner supply means insofar as they constitute a mechanism capable of controlling an amount of toner to be supplied.

Although each of the above described embodiments is directed to a case in which the invention is applied to a copying apparatus, the present invention is not limited to the copying apparatus and it is applicable to toner supply control in various image forming apparatuses such as a laser printer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:
image forming means for performing image forming operation,
developing means for developing, by using developer containing toner, an image formed by said image forming means,
toner supply means for supply toner to said developing means,
first control means for controlling said toner supply means, to supply a prescribed amount of toner with prescribed timing during said image forming operation,
toner density detection means for detecting a toner density of the developer in said developing means;
second control means for controlling said toner supply means, to continue supply of toner till it is determined that the toner density in said developing means attains a prescribed density, in response to an output of said toner density detection means;
first input means for instructing a start of operation of said image forming means, and
second input means for instructing a start of operation of said second control means.

2. An image forming apparatus in accordance with claim 1, wherein
said second control means controls operation of said toner supply means in association with image forming operation by said image forming means.

3. An image forming apparatus in accordance with claim 2, further comprising
means for permitting a start of image forming operation by said image forming means during toner supply operation by said second control means,
said second control means continuing supply of toner even during the permitted image forming operation.

4. An image forming apparatus in accordance with claim 3, wherein
said second control means continues supply of toner if the toner density in said developing means detected by said toner density detection means is lower than said prescribed density at the end of said permitted image forming operation.

5. An image forming apparatus in accordance with claim 2, further comprising
means for delaying a start of said image forming operation till toner supply operation by said second control means comes to an end if the start of said image forming operation by said image forming means is instructed by said first input means during the toner supply operation by said second control means.

6. An image forming apparatus in accordance with claim 2, further comprising
multi-operation means for performing multi-operation for starting operation of said image forming means to perform said image forming operation successively by a plural number of times, wherein said multi-operation means interrupts said multi-operation to cause said second control means to perform supply of toner when a start of the supply of toner by said second control means is instructed by said second input means during said multi-operation, and said multi-operation means restarts said multi-operation after the end of said supply of toner.

7. An image forming apparatus in accordance with claim 2, wherein
said second control means comprises:
comparing means for comparing, by a prescribed number of times, the toner density in said developing means detected by said toner density detection means with said prescribed density,
count means for counting the number of comparisons by said comparing means to the prescribed number, and
determination means for determining that the toner density in said developing means does not attain said prescribed density, and instructing supply of toner, when the number of determinations by said comparing means that said detected toner density is lower than said prescribed density is more than half of said number of comparisons.

8. An image forming apparatus in accordance with claim 7, wherein
said second control means repeats comparing operation by a prescribed number of times by said comparing means, counting operation by said count means and determination operation by said determination means till it is determined that the toner density in said developing means attains said prescribed density.

9. An image forming apparatus in accordance with claim 7, further comprising
means for stirring, for a prescribed period, the developer in said developing means, prior to measurement of toner density by said toner density detection means, said means being operated in response to the operation start instruction of said second control means issued by said second input means.

10. An image forming apparatus in accordance with claim 1, further comprising
means for instructing stop of supply of toner from said toner supply means.

11. An image forming apparatus in accordance with claim 1, wherein
said prescribed amount of toner supplied from said toner supply means by said first control means is an amount estimated to be inevitably consumed irrespective of development by said developing means.

12. An image forming apparatus in accordance with claim 1, wherein
said toner density detection means comprises a magnetic sensor.

13. An image forming apparatus comprising:
image forming means for performing image forming operation,
developing means for developing, by using developer containing toner, an image formed by said image forming means,
toner supply means for supplying toner to said developing means,
first control means for controlling said toner supply means, to supply a prescribed amount of toner with prescribed timing during said image forming operation, toner density detection means for detecting a toner density of the developer in said developing means;

second control means for controlling said toner supply means, to continue supply of toner till it is determined that the toner density in said developing means attain a prescribed density, in response to an output of said toner density detection means; and means for permitting a start of image forming operation by said image forming means during toner supply operations by said second control means, said second control means continuing supply of toner even during the permitted image forming operation.

14. An image forming apparatus comprising:

image forming means for performing image forming operation, developing means for developing, by using developer containing toner, an image formed by said image forming means, toner supply means for supplying toner to said developing means, first control means for controlling said toner supply means, to supply a prescribed amount of toner with prescribed timing during said image forming operation, toner density detection means for detecting a toner density of the developer in said developing means;

second contorl means for controlling said toner supply means, to continue supply of toner till it is determined that the toner density in said developing means attains a prescribed density, in response to an output of said toner density detection means; and means for delaying a start of said image forming operation till toner supply operation by said second control means come to an end if the start of said image forming operation by said image forming means is instructed by said first input means during the toner supply operation by said second control means.

15. An image forming apparatus comprising:

image forming means for performing image forming operation, developing means for developing, by using developer containing toner, an image formed by said image forming means, toner supply means for supplying toner to said developing means, first control means for controlling said toner supply means, to supply a prescribed amount of toner with prescribed timing during said image forming operation, toner density detection means for detecting a toner density of the developer in said developing means;

second control means for controlling said toner supply means, to continue supply of toner till it is determined that the toner density in said developing means attains a prescribed density, in response to an output of said toner density detection means; and multi-operation means for performing multi-operation for starting operation of said image forming means to perform said image forming operation successively by a plural number of times, wherein said multi-operation means interrupts said multi-operation to cause said second control means to perform supply of toner when a start of the supply of toner by said second control means is instructed by said second input means during said multi-operation, amd said multi-operation means restarts said multi-operation after the end of said supply of toner.

* * * * *